United States Patent [19]

Eubank, Jr.

[11] 4,211,023

[45] Jul. 8, 1980

[54] PICTURE FRAME

[76] Inventor: Joseph P. Eubank, Jr., c/o Eubank Frame Co., P.O. Box 582, Inverness, Calif. 94937

[21] Appl. No.: 944,088

[22] Filed: Sep. 20, 1978

[51] Int. Cl.[2] ..... G09F 1/12

[52] U.S. Cl. ..... 40/155; 40/152.1; 248/490

[58] Field of Search ..... 40/152.1, 155, 156, 40/153, 154, 152, 158; 248/490, 488, 491

[56] References Cited

U.S. PATENT DOCUMENTS

| | | | |
|---|---|---|---|
| 2,810,226 | 10/1957 | Horwitt | 40/152.1 X |
| 3,676,944 | 7/1972 | Eubank | 248/490 X |
| 3,958,352 | 5/1976 | Eubank | 40/152.1 X |
| 4,028,832 | 6/1977 | Wu | 40/155 |
| 4,103,446 | 8/1978 | Maglott | 40/152.1 X |

*Primary Examiner*—John F. Pitrelli
*Attorney, Agent, or Firm*—Harding, Earley & Follmer

[57] ABSTRACT

A picture frame is comprised of a corner clip for each corner of a rectangular picture assembly, each corner clip including a pair of legs joined at a vertex portion and extending at right angles to one another. Each leg has an end portion extending around an associated edge of the picture assembly to the front thereof for engaging the same. Each leg and associated end portion is made of a thin strip of material extending in a plane perpendicular to the picture assembly with the end portion thereof presenting a thin edge to the front of the picture assembly. Cord means extends between a cord engaging means of each corner clip to urge the corner clips toward a central location of the picture assembly and the end portions into securing engagement with an associated edge of the picture assembly.

11 Claims, 17 Drawing Figures

PICTURE FRAME

BACKGROUND OF THE INVENTION

This invention relates to picture frames of the type which are adjustable for mounting pictures of various sizes. More particularly, this invention relates to adjustable picture frames such as those disclosed in my U.S. Pat. No. 3,676,944 and 3,958,352 which provide a firm mounting for the picture assembly while at the same time preventing warping thereof.

Other prior art patents made of record are U.S. Pat. Nos. 2,810,226, 3,003,272 and 4,028,832.

SUMMARY OF THE INVENTION

It is the general object of this invention to provide an adjustable picture frame of the type disclosed in my prior patents and which comprises several improvements thereover. To this end, the picture frame of the invention is comprised of corner clips having legs extending at right angles to one another and having end portions engaging the edges of the picture assembly, the legs and end portions being formed of a thin strip of material and being constructed and arranged to extend perpendicularly to the back of the picture assembly with the end portions thereof presenting a thin edge to the front of the picture assembly.

By reason of this construction there is provided an end portion that is best suited for resisting the bending stresses occurring at the edges of the picture assembly thereby allowing the use of soft material that will not damage the edge of the picture assembly which often comprises a pane of glass. The use of the flat strip construction arranged on edge, i.e., perpendicular to the picture assembly, provides an almost invisible picture assembly engaging portion as viewed from the front of the picture assembly while providing a strong structure capable of resisting bending of the picture assembly.

Other features of the invention will be discussed more fully hereafter in the detailed description of the invention.

DESCRIPTION OF THE PREFERRED EMBODIMENTS

The picture frame in accordance with the invention comprises a corner clip 20 associated with each corner of a rectangular picture assembly 21, which typically consists of a front pane of glass 22, a backing member 24, such as a foamboard, and a picture held therebetween. Each corner clip 20 is adapted to be engaged with the edges of the picture assembly 21 at each corner thereof.

Figure 3:
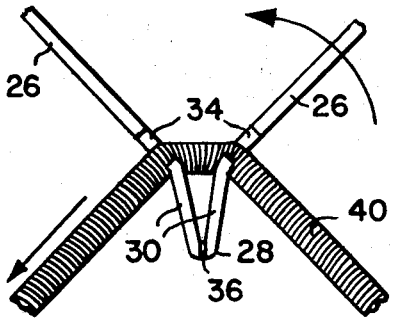
FIG. 3 is a fragmentary view of a part of a corner clip.
Figure 4:
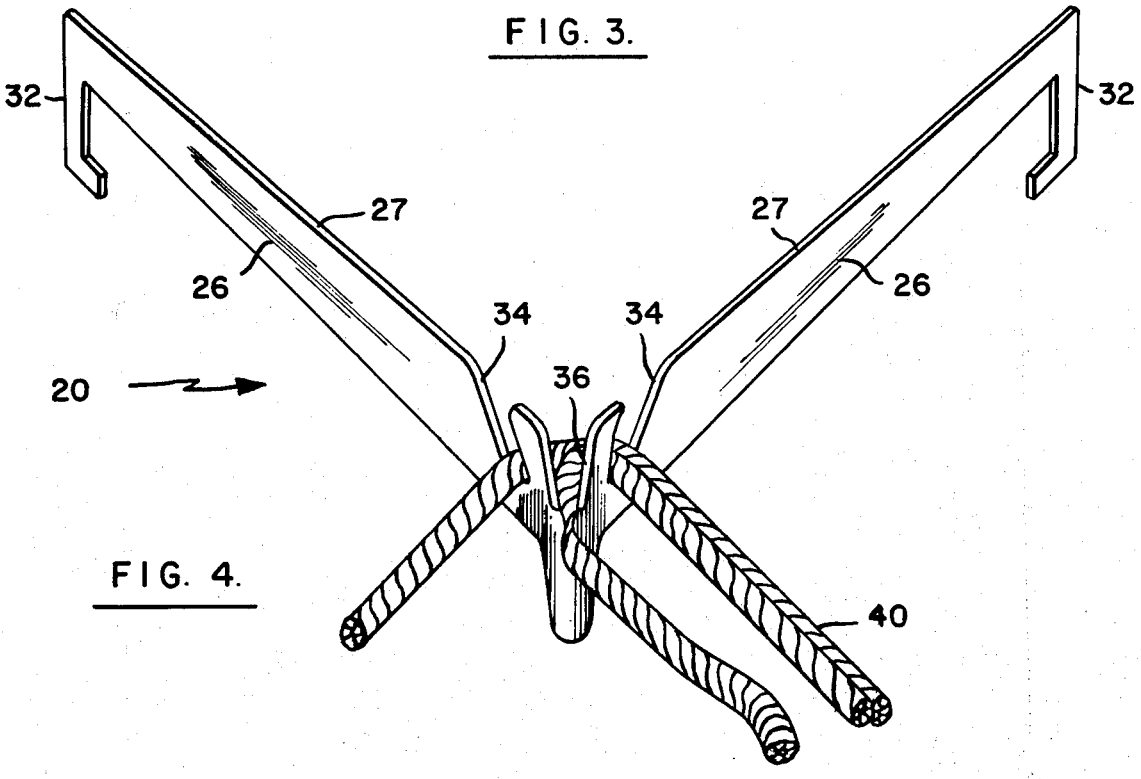
FIG. 4 is a view showing a corner clip engaged with a cord means.

Each corner clip 20 is made of a single piece of material stamped out of a flat sheet of soft aluminum and bent into the configuration best shown in FIGS. 3 and 4. As will be described more fully hereafter, each engaged corner clip 20 is constructed to present the edge of the material to the edge of picture assembly 21. This provides the best arrangement from a strength viewpoint for resisting the bending stresses occurring at the clip engaging region of picture assembly 21. Accordingly, this permits the use of a material such as soft aluminum or the like that does not damage the glass 22 of picture assembly 21.

Figure 2:
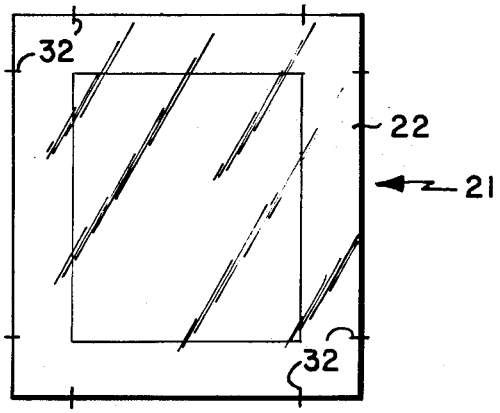
FIG. 2 is a front view of the picture assembly shown in FIG. 1.

Referring particularly to FIGS. 3 and 4, each corner clip 20 comprises a pair of legs 26 extending at right angles to one another and joined at a vertex portion 28. Vertex portion 28 comprises a V-shaped bend of a pair of leg portions 30 joined to legs 26. Each leg 26 extends from a vertex leg portion 30 along the back of picture assembly 21 to an end portion 32 which extends around the associated edge of picture assembly 21 to the front thereof for engaging the same with each leg 26 and end portion 32 extending in a plane perpendicular to picture assembly 21. End portions 32 present only a thin edge of material to the front of picture assembly 21 as shown in FIG. 2 to thereby be almost invisible.

Each corner clip 20 is provided with a cord engaging means in the form of a pair of cord slots 34 formed in legs 26. Each cord slot 34 extends inwardly form the back edge 27 of leg 26 and is located close to the vertex portion 28. Each vertex portion 28 is provided with a cord holding slot 36 located at the bend thereof as is shown in FIGS. 3 and 4. Holding slot 36 is narrower than the cord used to interconnect corner clips 20 as will be described more fully hereafter so that this cord can be held tightly therein.

There is provided a cord means extending between each of the corner clips 20 in engagement therewith in a manner to urge the same toward a central location of picture assembly 21 and to urge each end portion 32 into securing engagement with an associated edge of picture assembly 21. Such cord means comprises a cord 40 and spring 42 having one cord end tied thereto.

Figure 1:
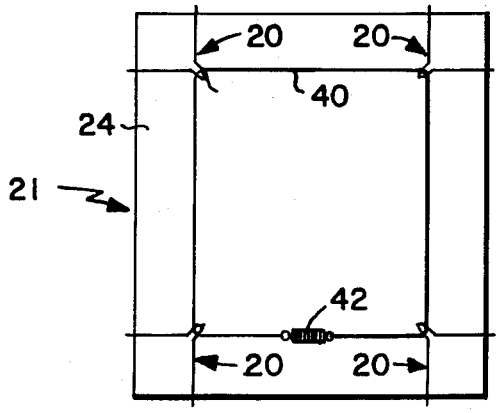
FIG. 1 is a view of the back of a picture assembly provided with a picture frame in accordance with the invention.

In mounting the picture frame on picture assembly 21, a corner clip 20 is placed at each corner of the picture assembly, after which cord 40, with spring 42 centered between the two bottom clip members 20 (FIG. 1), is run through the cord slots 34 of each corner clip 20 and back through the untied end of spring 40 in a manner to expand the spring 42 slightly to place the cord means in a biased tension condition. The remaining cord is then run back through some cord slots 34 and secured by pulling it down into a cord holding slot 36 of one of the corner clips 20. Picture assembly 21 is then hung on a wall hook or the like by engagement with the upper horizontally extending portion of the cord 40.

The above-described arrangement involving interconnecting corner clips 20 by the cord means in a manner to urge each corner clip inwardly toward the center of picture assembly 21 and the end portions 32 into securing engagement with an associated edge of the picture assembly provides a picture frame that provides a structural truss. This truss construction is described more fully in my prior patents and functions to reduce warping, while providing a hanging system which allows the picture assembly to keep away from the wall as if it were floating in space.

As is best shown in FIG. 3, cord slots 34 on legs 26 are located close to vertex portion 28 and, more importantly, close together and close to the intersection of the plane of the right angularly arranged legs 26. This is possible by providing the "pinched together" vertex construction described above. By providing cord slots 34 close together, the tendency for the corner clips 20 to be rotated by the action of cord 40, which could provide an uneven tension on the legs 26 extending from a corner clip, is minimized.

Figure 5:
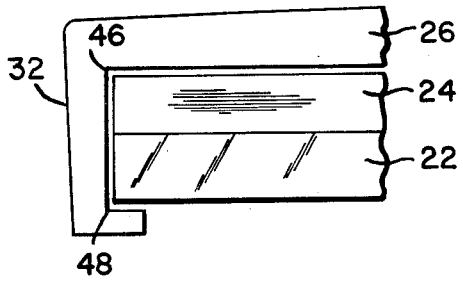
FIG. 5 is a fragmentary view showing the end portion of a corner clip in accordance with the invention in engagement with the edge of a picture assembly.
Figure 6:
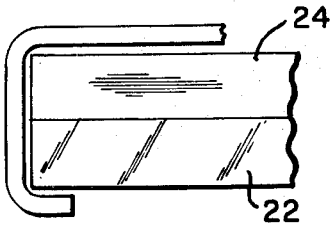
FIG. 6 is a fragmentary view similar to FIG. 5 of an end portion of a prior art corner clip.

A feature of the corner clip construction of the invention is that the interior edges of end portions 32 that engage or contact the outer edge of the picture assembly 21 can be made with very precise, sharp corners by reason of the flat clip construction that can be stamped out of a sheet of material. The advantage of this construction over prior art is illustrated by a comparison of FIGS. 5 and 6. In FIG. 5, the end portion 32 is shown as comprising sharp internal corners 46 and 48 which results in an even pressure being applied to the edge of the glass 22 so as to avoid damage thereof. By way of marked contrast, the bent clip construction of the prior art shown in FIG. 6 results in an uneven pressure beng applied on the corner of the edge of the glass 22 as is shown in FIG. 6. This occurs in the case of any bent wire or bent flat metal since such pieces cannot be bent without forming a radius of some type. The bent wire clip shown in U.S. Pat. No. 4,028,832 is this type of prior art construction and has the disadvantage described.

Figure 7:
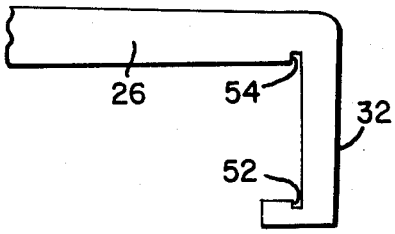
FIG. 7 is a fragmentary view showing a modified form of end portion of a corner clip in accordance with the invention.
Figure 8:
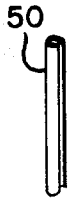
FIG. 8 is a view of a bumper for use with the end portion shown in FIG. 7.
Figure 9:
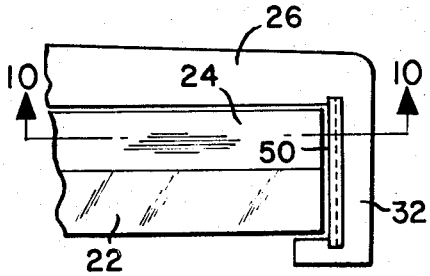
FIG. 9 is a fragmentary view showing a bumper in the end portion shown in FIG. 7.
Figure 10:
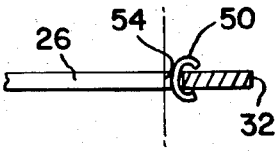
FIG. 10 is a sectional view taken on line 10—10 of FIG. 9.

In FIGS. 7 to 10, there is shown a modified end portion construction comprising a plastic bumper 50. Bumper 50 has a C-shaped cross-section and is adapted to be mounted on the end portion 32 of each corner clip leg 26. To this end, the internal corner of end portion 32 are provided with slots 52 and 54 (FIG. 7). The mounting of bumper 50 on end portion 32 is shown in FIGS. 9 and 10. In the mounted position bumper 50 serves to provide a resilient shield between end portion 32 and the edge of the picture assembly 21.

Figure 11:
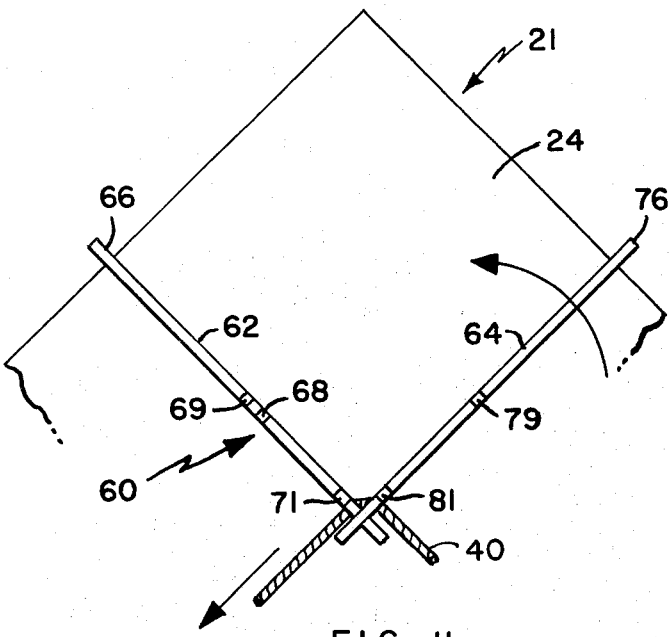
FIG. 11 is a fragmentary view showing another form of corner clip in accordance with the invention in engagement with a corner of a picture assembly.

In FIGS. 11 to 17, there is shown another form of corner clip in accordance with the invention particularly adapted for a large size picture assembly and easily adjustable to fit various size picture assemblies. To this end,, there is provided a corner clip 60 comprising a pair of clip members 62 and 64 adapted to be secured together in crossed relation to extend at right angles to one another and to extend perpendicularly to the edge of the picture assembly 21 engaged thereby (FIG. 11). Clip members 62 and 64 are made of a single piece of material stamped out of a flat sheet of aluminum or the like.

Each clip member 62 provides one leg of a corner clip 60 and is adapted to extend along the back of the picture assembly 21 as shown in FIG. 11. Each clip member 62 includes an end portion 66 which extends around an associated edge of the picture assembly 21 to the front thereof for engaging the same with clip member 62 extending in a plane perpendicular to picture assembly 21. In its mounted condition end portion 66 presents only a thin edge to the front of picture assembly 21. A pair of spaced apart notches 68 and 70 are provided in clip member 62 and extend from the top edge thereof as viewed in FIG. 13 about one-half the width of the clip member 62 for use in connecting clip members 62 and 64 together in crossed relation as will be described more fully hereafter. A pair of cord slots 69 and 71 are provided in clip member 62 to extend downwardly from the top edge thereof at locations adjacent to notches 68 and 70, respectively. Clip member 62 is also provided with a cord holding slot 72 located in the end opposite end portion 66. Holding slot 72 is narrower than the cord 40 used to interconnect corner clips 60 so that this cord can be secured therein.

Each clip member 64 provides one leg of a corner clip 60, is adapted to extend along the back of picture assembly 21 and includes an end portion 76 which extends around an associated edge of picture assembly 21 to the front thereof for engaging the same with clip member 62 extending in a plane perpendicular to picture assembly 21. In its mounted condition, end portion 76 presents only a thin edge to the front of picture assembly 21. A pair of spaced apart notches 78 and 80 are provided in clip member 64 and extend from the bottom edge thereof as viewed in FIG. 13 about one-half the width of clip member 64 for use in securing clip members 62 and 64 together in crossed relation as will be described more fully hereafter. A pair of cord slots 79 and 81 are provided in clip member 72 and extend downwardly from the top edge thereof at locations adjacent to notches 78 and 80, respectively. Clip member 64 is provided with a cord holding slot 82 located in the end opposite end portion 76. Holding slot 82 is narrower than the cord used to interconnect corner clips 60 so that this cord can be secured therein.

Figure 14:
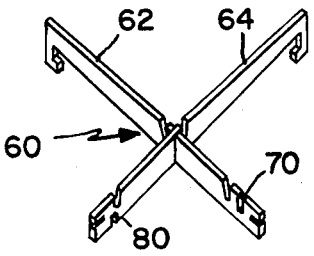
FIGS. 14, 15, 16 and 17 are perspective views showing four possible combinations of the clip members shown in FIGS. 11 to 13 to accommodate various sizes of picture assemblies.
Figure 16:
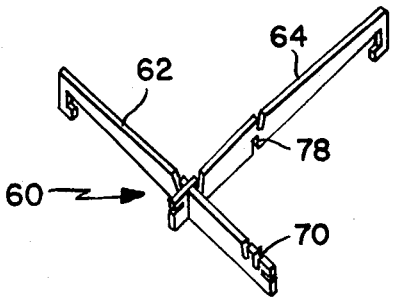
Figure 15:
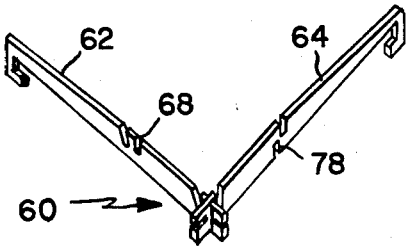
Figure 17:
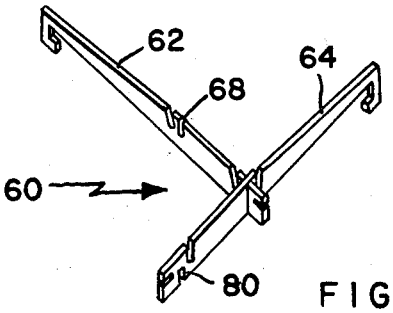

By reason of the above-described notched construction, each pair of clip members 62 and 64 is provided with cooperating engaging portions for securing clip members 62 and 64 together in crossed relation by a friction fit at two locations along the length thereof. Thus, clip members 62 and 64 may be secured together with notch 68 aligned with either notch 78 (as shown in FIG. 14) or with notch 80 (as shown in FIG. 16). Clip members 62 and 64 may also be secured together with notch 70 aligned with either notch 80 (as shown in FIG. 15) or with notch 78 (as shown in FIG. 17). Accordingly, clip members 62 and 64 may be assembled together in any of the four positions shown in FIGS. 14 to 17.

Figure 12:
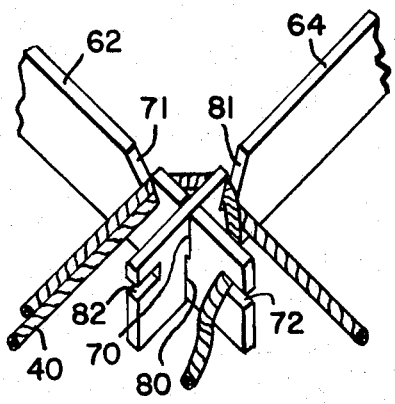
FIG. 12 is a detail view showing the intersection of the legs of the corner clip of FIG. 11 and the engagement thereof with a cord means.
Figure 13:
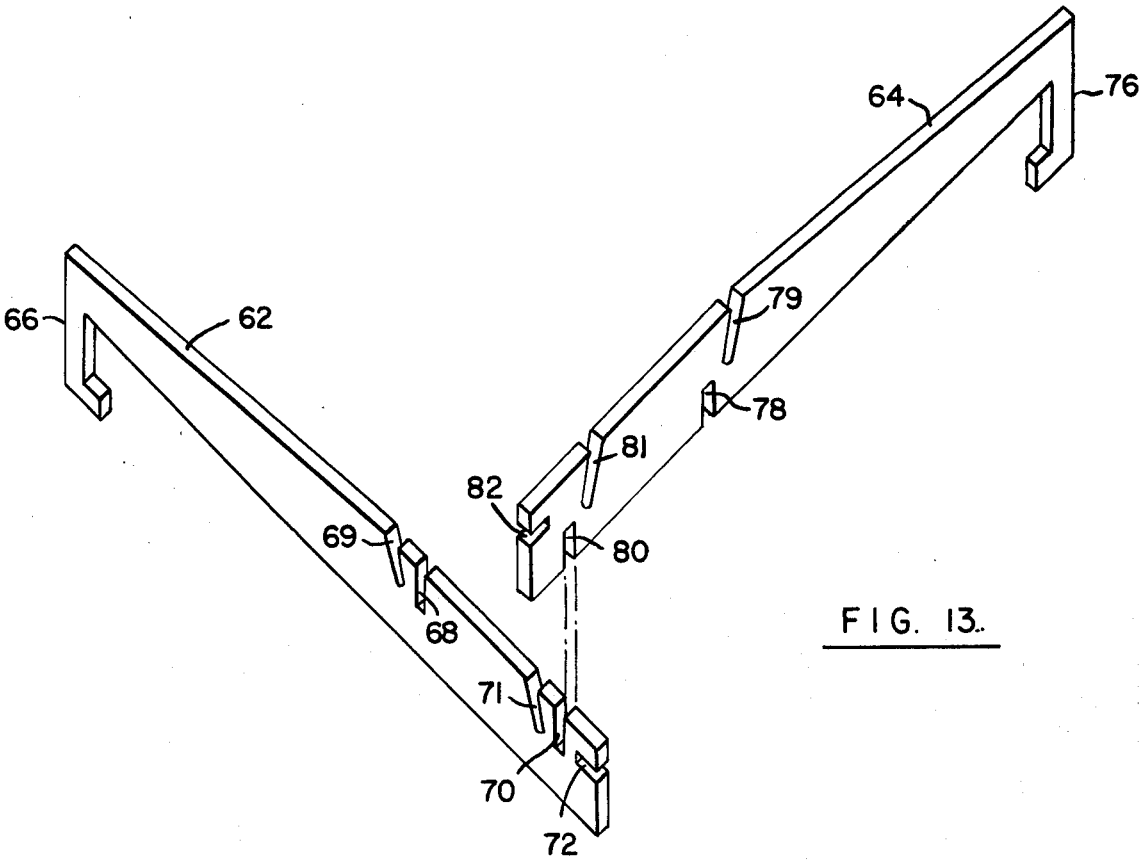
FIG. 13 is a view illustrating the manner in which the clip members of the corner clip shown in FIG. 11 are fitted together.

A picture frame comprising four of the corner clips 60 is assembled onto a picture assembly in the same manner as the corner clips 20, with the assembled corner clips 60 being engaged with the edges at the corners of picture assembly 21 and with clip members 62 and 64 extending perpendicularly to these edges as is shown in FIG. 11. The four corner clips 60 are then interconnected by cord means as described above with respect to the embodiment of FIGS. 1 to 4 with a cord 40 being run through two of the cord slots 69, 71, 79, 81 closest to the intersection of the clip members 62 and 64 at each corner as is shown in FIGS. 11 and 12. In FIG. 11, for example, the cord 40 is run through cord slots 71 and 81. The cord 40 is then engaged with the spring 42 of the cord means in a manner to expand the same slightly to place the cord means in a biased tensioned condition. The remaining cord is run back through some of the cord slots and secured in position by pulling it into a holding slot such as slot 72 as shown in FIG. 12.

It will be apparent that various changes may be made in the construction and arrangement of parts without departing from the scope of the invention as defined by the following claims.

I claim:

1. A picture frame comprising:

a corner clip for each corner of a rectangular picture assembly and adapted to be engaged therewith, each corner clip comprising a pair of legs extending at right angles to each other and joined at a vertex portion with each leg extending from said vertex portion along the back of the picture assembly to an end portion, said end portion of each leg extending around an associated edge of the picture assembly to the front thereof for engaging the same, each leg and associated end portion being comprised of a flat thin strip of material extending in a plane perpendicular to the picture assembly, the dimension of said strip in said plane being several times greater than the thickness of said strip, said end portion of each leg presenting the edge of said thin strip of material to the front of the picture assembly, each corner clip having a cord engaging means, and a cord means extending between each of said corner clips and engaging the cord engaging means thereof to urge said corner clips toward a central location of the picture assembly with said end portion of each leg of each corner clip being urged into securing engagement with an associated edge of the picture assembly.

2. A picture frame according to claim 1 wherein each of said corner clips is made of one piece of material, said vertex portion of each corner clip comprising a V-shaped bend including a pair of vertex leg portions joined to said legs thereof.

3. A picture frame according to claim 2 wherein said cord engaging means of each corner clip comprises a pair of slots, one slot being formed in each of said pair of legs at a location close to the location where said vertex leg portions are joined to said legs, said slots having open ends facing outwardly from the back of the picture assembly and terminating at a location spaced a substantial distance from the back of the picture assembly.

4. A picture frame according to claim 3 wherein said vertex portion of at least one of said corner clips is formed with a cord holding slot having a width less than the diameter of said cord means and having an open end facing outwardly from the back of the picture assembly.

5. A picture frame according to claim 1 wherein said end portions are formed with sharp straight-edged right angle corners adapted to receive the corners of the edge of a picture assembly of a size equal to the spacing between said corners without pressing thereagainst.

6. A picture frame according to claim 5 including a resilient bumper mounted on said end portions to face the edge of the picture assembly engaged thereby.

7. A picture frame according to claim 1 wherein each of said corner clips comprises:

a pair of clip members each of which includes one of said pair of legs and the associated end portion thereof, each pair of clip members for a corner clip being provided with first cooperating engaging portions for securing a pair of clip members together in crossed relation at a first location and second cooperating engaging portions for securing a pair of clip members together in crossed relation at a second location.

8. A picture frame according to claim 7 wherein said cooperating portions for securing a pair of clip members together are provided by a pair of spaced apart notches in each of said legs, said notches being constructed and arranged so that the clip members fit together by having a notch on one clip member slip into a notch on the other clip member with a portion of the leg of each clip member received in an associated notch.

9. A picture frame according to claim 8 wherein said cord engaging means on each clip member comprises slots in each of said legs at a location close to the location of said notches whereby the cord engaging means is engaged by the cord means at a location close to the intersection of the crossed clip members.

10. A picture frame according to claim 8 wherein at least a plurality of said corner clips are provided with a cord holding slot havng a width of less than the diameter of said cord means.

11. A picture frame according to claim 1 wherein the strip of material forming said clip members is a soft material that does not cause damage to the picture assembly upon engagement therewith.

* * * * *